US009799321B2

(12) United States Patent
Nesbit, Jr. et al.

(10) Patent No.: US 9,799,321 B2
(45) Date of Patent: Oct. 24, 2017

(54) WAVEGUIDE FOR A BOAT

(71) Applicants: Donald C. Nesbit, Jr., North Bay Village, FL (US); Bellal J. Hamze, Margate, FL (US); Gregory A. Meloon, Orlando, FL (US); Eric J. Miller, Kissimmee, FL (US)

(72) Inventors: Donald C. Nesbit, Jr., North Bay Village, FL (US); Bellal J. Hamze, Margate, FL (US); Gregory A. Meloon, Orlando, FL (US); Eric J. Miller, Kissimmee, FL (US)

(73) Assignee: JL Audio, Inc., Miramar, FL (US)

( * ) Notice: Subject to any disclaimer, the term of this patent is extended or adjusted under 35 U.S.C. 154(b) by 36 days.

(21) Appl. No.: 14/963,623

(22) Filed: Dec. 9, 2015

(65) Prior Publication Data

US 2017/0169810 A1 Jun. 15, 2017

(51) Int. Cl.
*G10K 11/28* (2006.01)
*H04R 1/02* (2006.01)

(52) U.S. Cl.
CPC ..... *G10K 11/28* (2013.01); *H04R 1/025* (2013.01); *H04R 2499/13* (2013.01)

(58) Field of Classification Search
CPC ..... H04R 2499/13; H04R 1/025; G10K 11/28
USPC ..... 181/140, 148, 149, 150, 152, 155, 156
See application file for complete search history.

(56) References Cited

U.S. PATENT DOCUMENTS 3,065,817 A * 11/1962 Bailey ..... H04R 1/44 181/149
4,924,962 A * 5/1990 Terai ..... H04R 1/2857 181/141
4,942,939 A * 7/1990 Harrison ..... H04R 1/2857 181/145
5,218,175 A * 6/1993 Scarlata ..... B60R 11/0217 181/141
5,740,259 A * 4/1998 Dunn ..... H04R 1/2842 181/148
5,821,471 A * 10/1998 McCuller ..... H04M 1/035 181/156
7,463,746 B2 * 12/2008 Caron ..... H04R 1/345 181/155
7,628,249 B2 * 12/2009 Hanna ..... B60R 11/0217 181/141
7,743,878 B1 * 6/2010 Moore ..... H04R 1/2865 181/145
7,861,825 B2 * 1/2011 Stewart, Jr. ..... H04R 1/2865 181/148
2004/0109575 A1 * 6/2004 Thigpen ..... H04R 5/02 381/302
2006/0201739 A1 * 9/2006 Tanaami ..... H04R 1/2826 181/156
2009/0242319 A1 * 10/2009 Stathopoulos ..... G08B 3/10 181/149

(Continued)

FOREIGN PATENT DOCUMENTS

JP 2007137368 A * 6/2007

*Primary Examiner* — Forrest M Phillips
(74) *Attorney, Agent, or Firm* — GrayRobinson, P.A.; Thomas L. Kautz

(57) ABSTRACT

A waveguide mounted in the area beneath the helm of a boat directs acoustic output from one or more loudspeakers to its windshield where the sound can be contained, reinforced and directed toward the entertainment areas of the boat.

8 Claims, 5 Drawing Sheets

(56) References Cited

U.S. PATENT DOCUMENTS

| | | | | |
|---|---|---|---|---|
| 2011/0061964 | A1* | 3/2011 | Stewart, Jr. ..... | H04R 1/2865<br>181/152 |
| 2012/0263306 | A1* | 10/2012 | McGowan ..... | H04R 1/403<br>381/17 |

* cited by examiner

WAVEGUIDE FOR A BOAT

FIELD OF THE INVENTION

This invention relates to sound systems for boats, and, more particularly, to a waveguide which directs acoustic output from one or more loudspeakers toward the windshield of the boat where it may be redirected to passengers in the entertainment area of the vessel.

BACKGROUND OF THE INVENTION

Waveguides are physical structures that guide the propagation of waves, such as sound waves or electromagnetic (radio) waves. In operation, waveguides physically restrict the expansion of a wave to minimize signal energy loss over distance. For example, an acoustic wave emitted from a spherical point source loses energy according to the inverse square law over distance as it radiates into three dimensional space. If an acoustic source is coupled to a waveguide, however, the sound energy is contained until it can be redirected as desired.

Loudspeakers employed in sound systems for boats are typically mounted in side bulkheads, similar to sound systems for vehicles such as automobiles and trucks where the loudspeakers are mounted in the vehicle doors. Door-mounted loudspeakers work reasonably well in vehicles because of the enclosed cabin to contain the acoustic energy and prevent wind noise, which allows adequate sound volume and quality. Mounting loudspeakers in the bulkheads of boats is less effective because the cockpits or helms of boats are typically open to the air with essentially no enclosure. This allows the acoustic energy from loudspeakers to dissipate quickly as it radiates into space. Further, using such mounting arrangement in boats, if the speaker is not facing the occupants some frequencies may seem entirely absent because midrange and high-frequency sound is very directional. Additionally, boat helms are designed for easy access, with the assumption that occupants will frequently move around on deck and be less static than an automotive passenger.

Typical ski boats, bow riders, wakeboard boats and deck boats do not have a cabin or enclosed helm but are usually equipped with a windshield running entirely across the width of the deck for the protection of passengers. Often the entertainment areas of such boats are on the aft deck located behind, but relatively far away from, the windshield. With the noise of the open deck, providing loud, quality sound in the entertainment areas, and especially behind the boat, is often a challenge.

SUMMARY OF THE INVENTION

This invention is directed to sound systems for boats, and, more particularly, to a waveguide which directs acoustic output from one or more loudspeakers to the windshield of the boat where it can be contained, reinforced and directed toward the entertainment areas of the vessel.

This invention is predicated on the concept of employing a waveguide mounted below the helm area of a boat to direct sound output from one or more loudspeakers to the base of the windshield of the boat. In many vessels, the windshield is sloped upward from the helm to protect passengers from wind and water. The helm of such vessels, like the dashboard of vehicles, is usually compact and does not provide sufficient area to mount loudspeakers of larger diameter that are needed to produce robust sound output. Using the waveguide of this invention, a larger speaker may be mounted in the free space below the helm area with the waveguide providing a path along the relatively long, narrow space just below the windshield.

In the presently preferred embodiment, the waveguide comprises a housing having a hollow interior formed with an acoustic inlet opening and at least one acoustic outlet opening. An adaptor is coupled to the acoustic inlet opening which is effective to mount a loudspeaker such that its acoustic output is directed into the housing interior. The housing is connected to a mounting bracket secured over one or more openings formed in the helm of the boat. A trim piece overlies the mounting bracket to provide a finished appearance to the waveguide. The housing and loudspeaker are therefore suspended by the mounting bracket within the open space beneath the helm in position such that the acoustic output from the loudspeaker passes through the acoustic inlet opening into the housing interior, through the acoustic outlet opening and mounting bracket, and, onto the base of the windshield of the boat.

Guiding of the acoustic output from the loudspeaker in this manner allows it to emerge in exactly the desired location at the base of the windshield with very little loss of sound energy. The acoustic output is contained, reinforced and impinges against the base of the windshield whose natural slope helps to direct the sound rearward toward the passengers and entertaining area. As a result, the acoustic output is louder and of higher perceived quality where it is most needed. Further, by employing the waveguide of this invention the presentation of sound seems more natural to passengers since it emanates from the windshield in front of the listeners rather than from the sides of the boat or from below the helm area.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
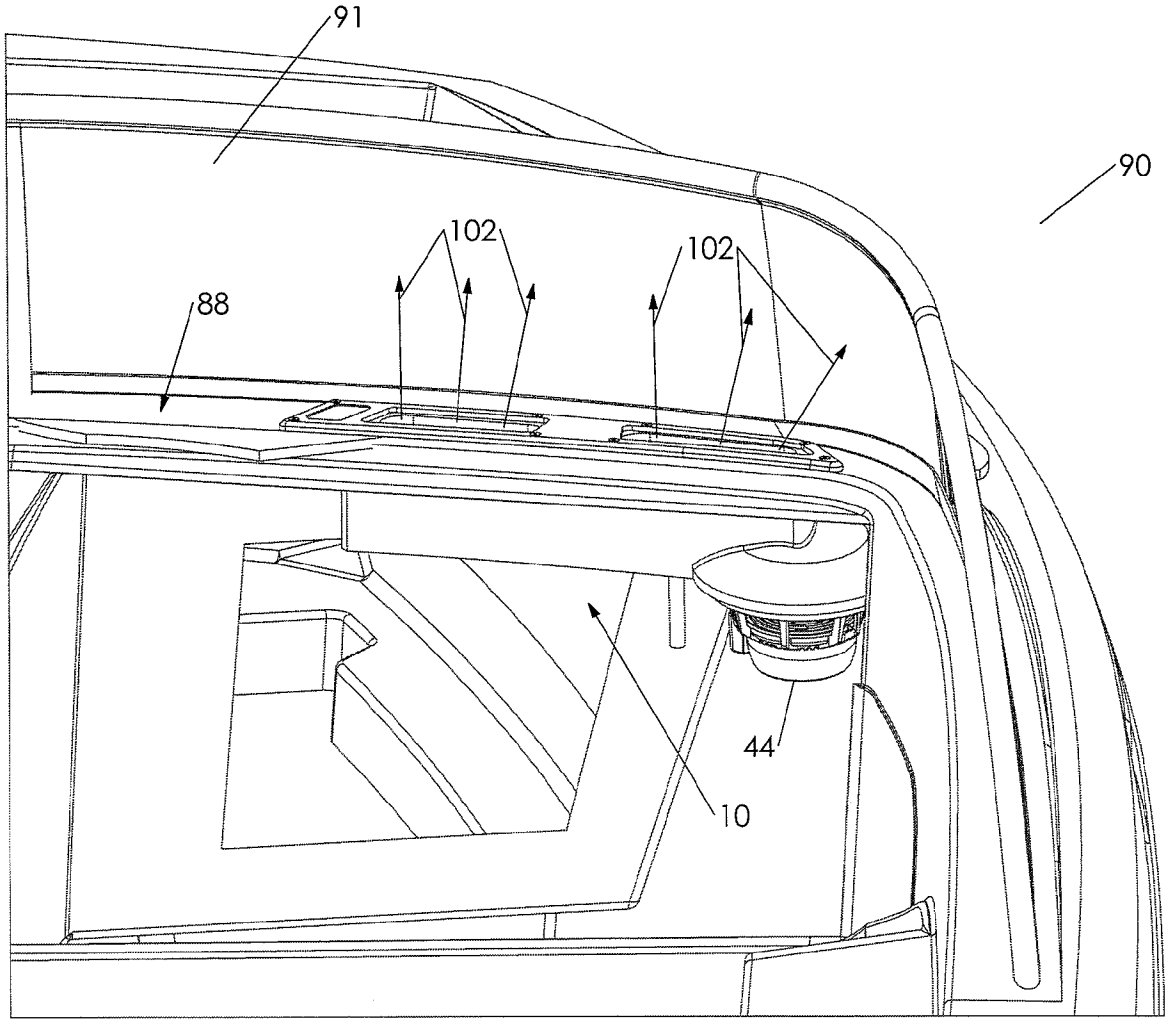
FIG. 1 is a partial perspective view of the waveguide of this invention mounted beneath the helm of a boat.

Referring initially to FIGS. 2-5, the waveguide 10 of this invention comprises a housing 12 having a front wall 14, a back wall 16, a top wall 18, a bottom wall 20 and opposed end walls 22, 24 defining a hollow interior 26. A tube 27 is mounted to the bottom wall 20 to drain any water that may enter the housing 12. For purposes of the present discussion, the terms "front," "back," "top," "bottom," "up," "upwardly," "down" and "downwardly" refer to spatial relationships with the orientation of the waveguide 10 as depicted in the Figs. The end wall 24 is formed with an acoustic inlet opening 28. The top wall 18 is formed with two, elongated acoustic outlet openings 30 and 32, separated by a divider or central plate 34, and holes 35. In the presently preferred embodiment, an adaptor 36 is mounted to the housing 12 at the acoustic inlet opening 28. The peripheral edge 38 of the adaptor 36 is connected by fasteners (not shown) to a ring 40, which, in turn, is mounted to the upper end of the frame 42 of a loudspeaker 44.

Figure 5:
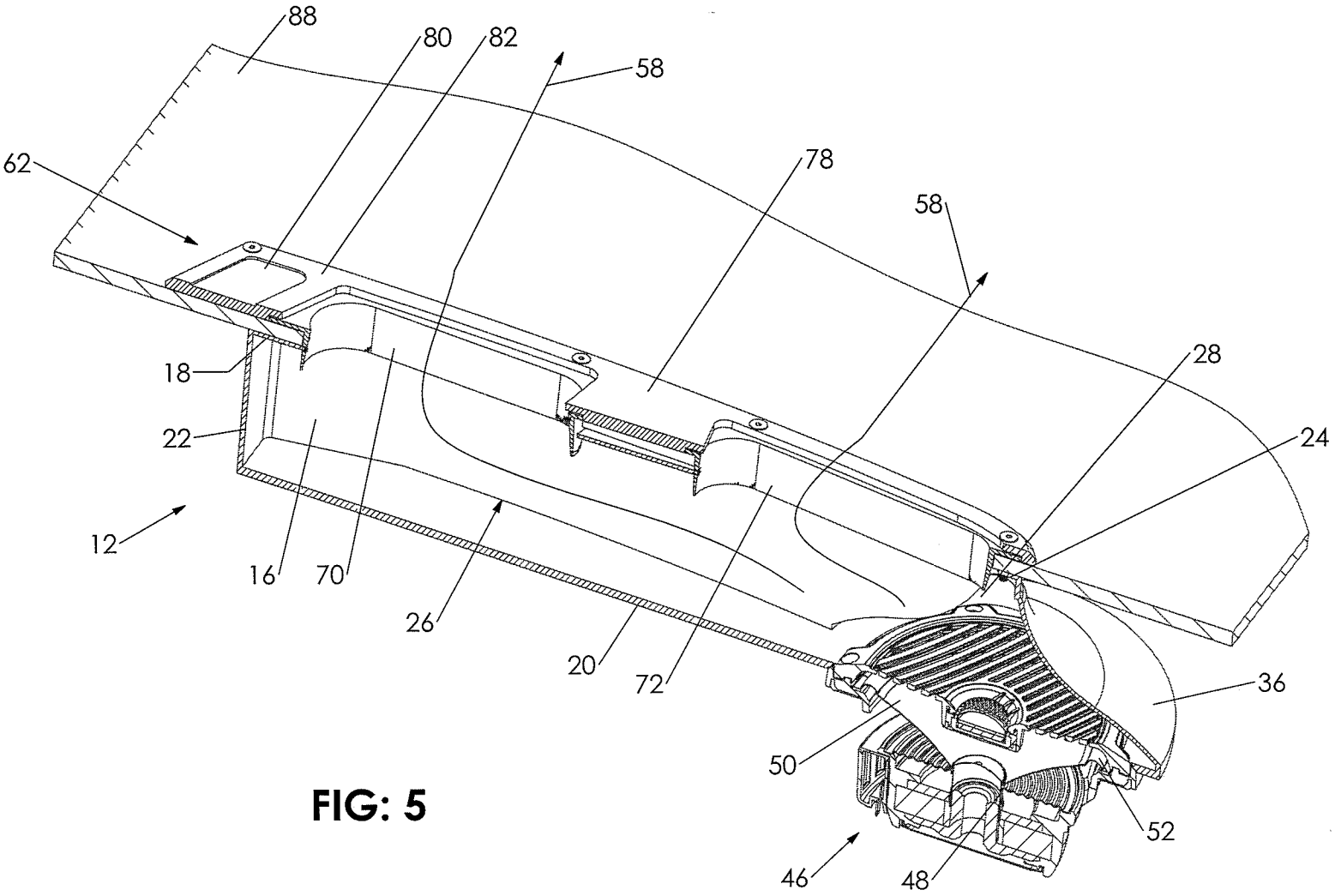
FIG. 5 is a cross sectional view of the assembled waveguide.

The construction of loudspeaker 44 forms no part of this invention, and therefore the details of same are not described herein. Referring to FIG. 5, the loudspeaker 44 generally includes a motor structure 46 including a voice coil 48 coupled to one end of a diaphragm 50 whose opposite end connects to an upper suspension 52. The loudspeaker 44 has a central dust cap 54, and an annular grille or cover 56 carried by the ring 40. In response to operation of the motor structure 46, acoustic output from the diaphragm 50 is transmitted in the direction of the arrows 58 shown in FIG. 5 through the adaptor 36 and acoustic inlet opening 28 into the interior 26 of the housing 12.

Figure 2:
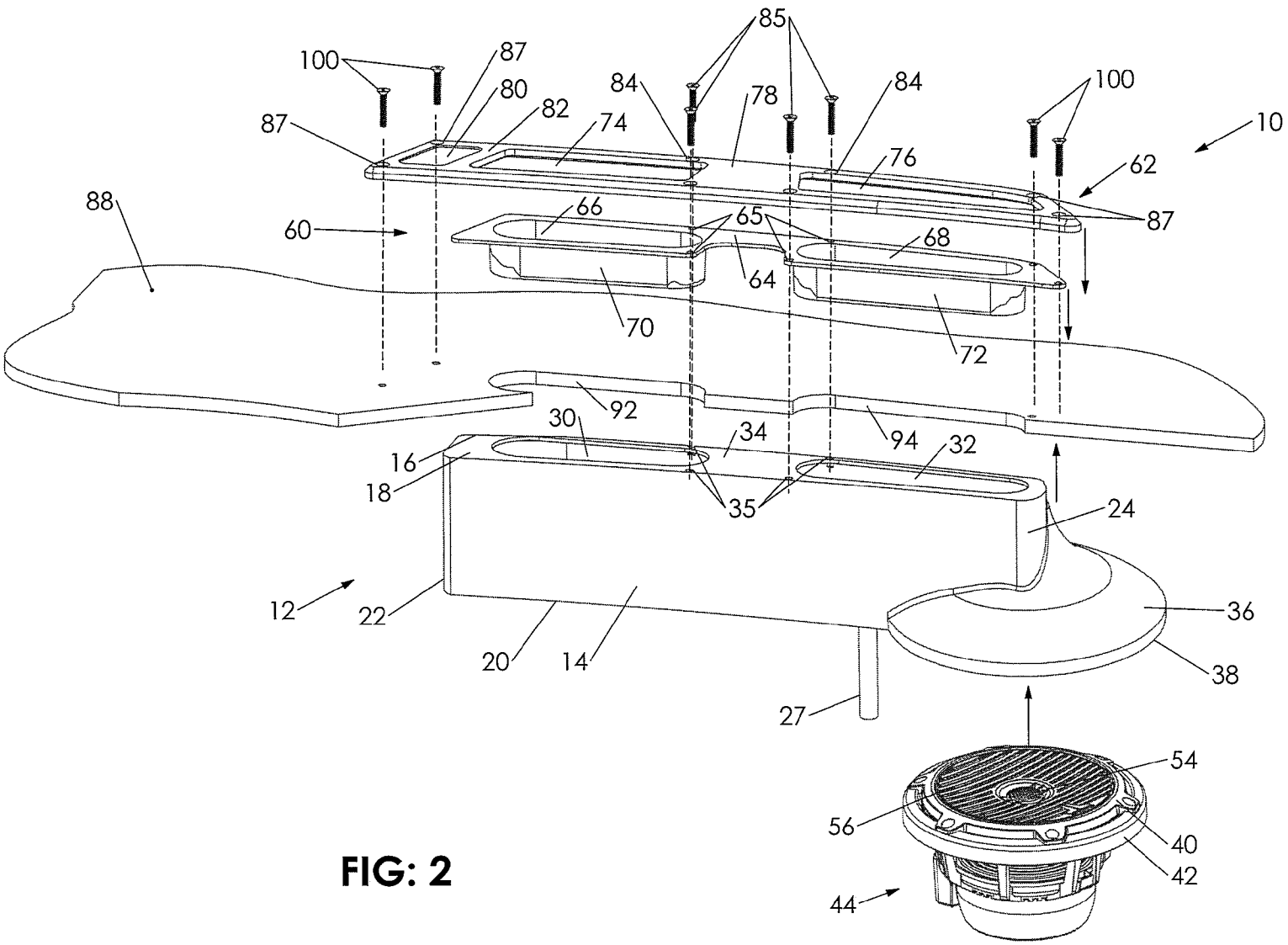
FIG. 2 is an exploded, perspective view of the waveguide and a loudspeaker adapted to mount to the waveguide.
Figure 3:
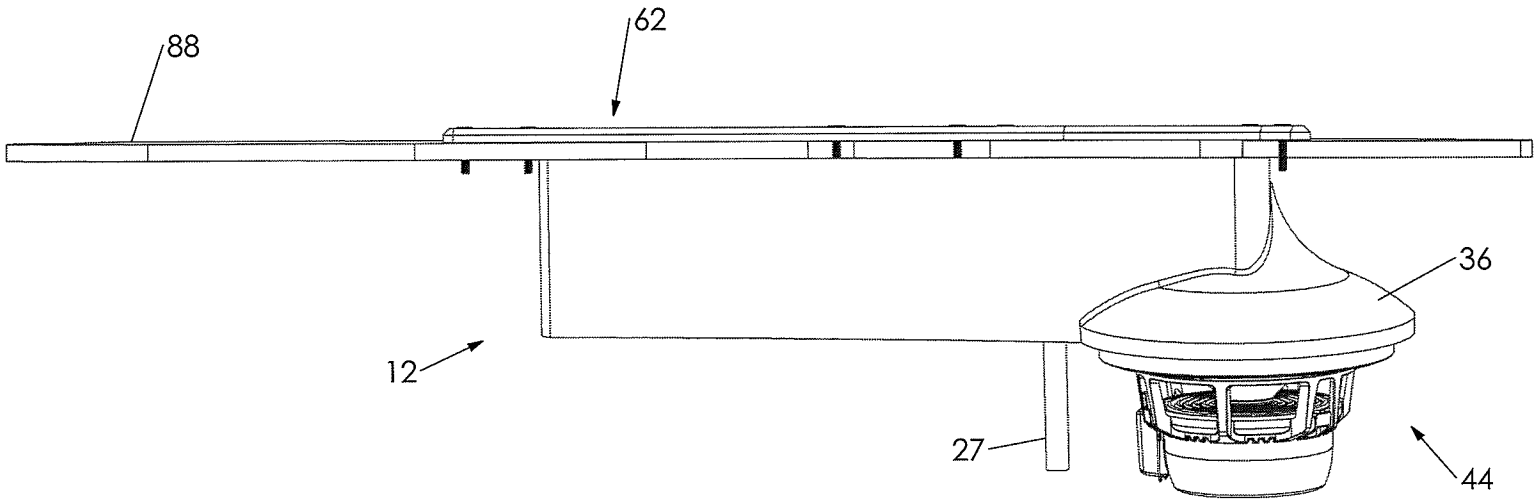
FIG. 3 is a view similar to FIG. 2 except with the waveguide assembled and connected to a loudspeaker and the helm of a boat.
Figure 4:
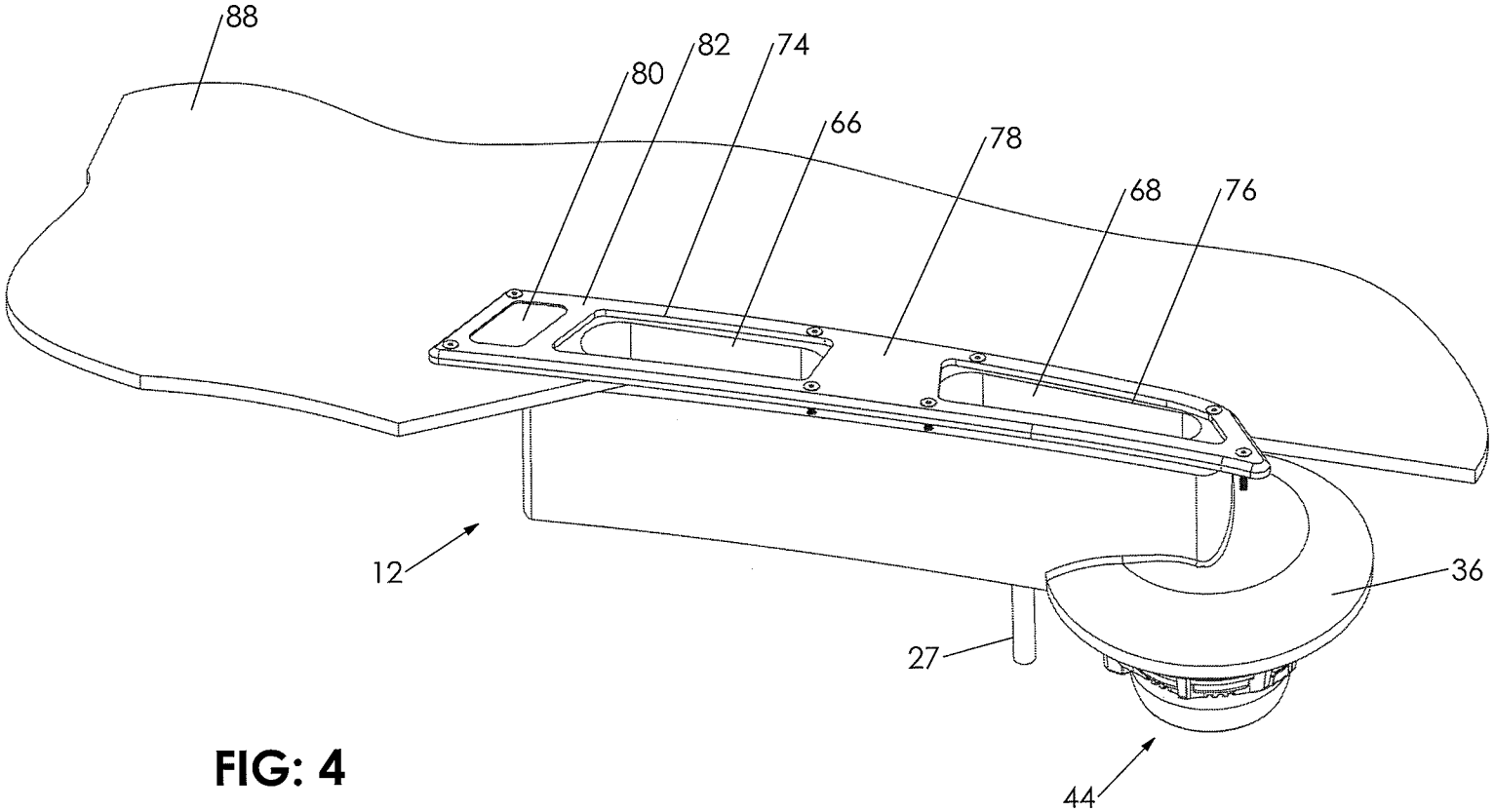
FIG. 4 is a perspective view of FIG. 3.

As best seen in FIG. 2, the waveguide 10 further includes a mounting bracket 60 and a trim piece 62. The mounting bracket 60 has a top wall 64 formed with holes 65 and spaced bracket openings 66 and 68. Extending downwardly from the bracket openings 66, 68 are hollow projections 70, 72, respectively. The trim piece 62 has two, spaced openings 74 and 76 separated by a plate 78, and another opening 80 spaced from the opening 74 by an end plate 82. Holes 84 for fasteners 85 are formed near the plate 78, and other holes 87 are formed at opposite ends of the bracket 62.

Referring now to FIG. 1, the waveguide 10 of this invention is schematically depicted within the space beneath the helm 88 of a boat 90 having a windshield 91, only a portion of which is shown in the drawings. The waveguide 10 is mounted to the helm 88, or other structural member of the boat 90, which is formed with two cut-outs 92 and 94. See FIG. 2.

The waveguide 10 is assembled and secured to the helm 88 by initially placing the projections 70, 72 of mounting bracket 60 into respective cut-outs 92, 94 in the helm 88 so that the peripheral edge of the top wall 64 of mounting bracket 60 rests atop the helm 88. The housing 12 is connected to the mounting bracket 60 from underneath the helm 88, i.e. the projections 70, 72 of mounting bracket 60 are received within respective acoustic outlet openings 30, 32 of the housing 12. An adhesive may be applied to the top wall 18 of housing 12 to hold it in place against the underside of helm 88 and in engagement with mounting bracket 60. The trim piece 62 may then be placed over the mounting bracket 60 and the cut-outs 92, 94 in the helm 88 such that its openings 74, 76 align with the bracket openings 66, 68 in mounting bracket 60 and with the acoustic outlet openings 30, 32 of housing 12. As best seen in FIG. 2, the trim piece 62, mounting bracket 60 and housing 12 are connected together by fasteners 85 which extend through holes 84 in the trim piece 62, the holes 65 in the top wall 64 of mounting bracket 60 and the holes 35 in the top wall 18 of housing 12 where they are tightened in place. The holes 87 at the ends of trim piece 62 receive fasteners 100 which mount the trim piece to the helm 88. The loudspeaker 44 is mounted by the adaptor 36 to the housing 12, as discussed above, which preferably takes place prior to coupling the housing 12 to the mounting bracket 60.

As illustrated in FIGS. 1 and 5, acoustic output from the loudspeaker 44 enters the housing interior 36 as described above and depicted by arrows 58. The acoustic output is confined within the housing interior 36 and guided by the acoustic outlet openings 30, 32 in housing 12, the projections 70, 72 in the mounting bracket 60, and the trim piece openings 74, 76 into contact with the bottom portion of the windshield 91 of the boat 90. See arrows 102 in FIG. 1. The windshield 91, in turn, directs the acoustic output in a rearward direction, toward the aft end of the boat 90 and its entertainment areas. The natural slope of the windshield 91 directs the acoustic output in this fashion, and is much more effective in providing louder and higher quality sound at the aft end of the boat 90 than in prior sound systems where loudspeakers are mounted in the bulkheads or other locations.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A waveguide for delivering acoustic output from a loudspeaker to a windshield which overlies the helm of a boat, comprising:

a housing having a hollow interior, said housing being foi lied with an acoustic inlet opening and at least one acoustic outlet opening;

an adaptor coupled to said acoustic inlet opening, said adaptor being effective to mount a loudspeaker in position outside of said hollow interior, said loudspeaker directing its acoustic output through said adaptor and through said acoustic inlet opening into said hollow interior of said housing;

a mounting bracket which mounts said housing to the helm of the boat, said mounting bracket having at least one bracket opening which aligns with said at least one acoustic outlet opening of said housing, said mounting bracket and said housing being positioned on the helm of the boat so that acoustic output from said loudspeaker is directed to the windshield of the boat whose slope redirects said acoustic output toward the aft end of the boat.

2. The waveguide of claim 1 in which said adaptor is located at one end of said housing, said adaptor having a peripheral edge mounted to the frame of the loudspeaker.

3. The waveguide of claim 1 in which said housing has a front wall, a back wall, a bottom wall, a top wall and opposed end walls interconnected to form said hollow interior, said top wall being formed with said at least one acoustic outlet opening.

4. The waveguide of claim 3 in which said at least one acoustic outlet opening comprises two acoustic outlet openings separated by a divider formed in said top wall of said housing.

5. The waveguide of claim 3 in which one of said end walls of said housing is formed with said acoustic inlet opening.

6. The waveguide of claim 1 further including a projection extending from said at least one bracket opening in said mounting bracket in position to mount within said at least one acoustic outlet opening in said housing.

7. The waveguide of claim 3 further including a drain tube connected to said bottom wall of said housing.

8. The waveguide of claim 1 further including a trim piece mounted to the helm of the boat over said mounting bracket.

* * * * *